US007327088B2

(12) United States Patent
Brady

(10) Patent No.: US 7,327,088 B2
(45) Date of Patent: Feb. 5, 2008

(54) MAGNETRON

(75) Inventor: Michael Barry Clive Brady, Maldon (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 68 days.

(21) Appl. No.: 11/394,088

(22) Filed: Mar. 31, 2006

(65) Prior Publication Data

US 2006/0220566 A1 Oct. 5, 2006

(30) Foreign Application Priority Data

Mar. 31, 2005 (GB) ..... 0506580.0

(51) Int. Cl.
*H01J 25/50* (2006.01)

(52) U.S. Cl. ..... 315/39.51; 315/39.53; 315/39.75

(58) Field of Classification Search ..... 315/39.51, 315/39.53, 39.55, 39.75
See application file for complete search history.

(56) References Cited

U.S. PATENT DOCUMENTS 3,114,123 A 12/1963 Kruechen et al.
5,998,934 A * 12/1999 Mimasu et al. ..... 315/118
6,653,788 B2 * 11/2003 Ogura et al. ..... 345/39.51

FOREIGN PATENT DOCUMENTS

| | | |
|---|---|---|
| GB | 2 238 424 A | 5/1991 |
| GB | 2 280 541 A | 2/1995 |
| GB | 2 297 190 A | 7/1996 |

OTHER PUBLICATIONS

United Kingdom Search Report Jun. 1, 2005.

* cited by examiner

*Primary Examiner*—David H. Vu
(74) *Attorney, Agent, or Firm*—Venable LLP; Robert Kinberg

(57) ABSTRACT

In a magnetron having a body 1 defining an anode 2 divided into resonant cavities 4 by vanes 3 and having a coaxial cathode 5, r.f. energy produced when a magnetic field is applied parallel to the axis of the anode is launched along a waveguide 8 by an antenna 6 in an evacuated region of the magnetron closed by a dielectric window 19. The latter has sector shaped conducting areas on its surface symmetrically arranged with respect to the antenna, the inductance of which balance the capacitance of the dielectric window, thereby reducing reflections at the window.

12 Claims, 3 Drawing Sheets

MAGNETRON

CROSS-REFERENCE TO RELATED APPLICATION

This application claims the priority of British Patent Application No. 0506580.0 filed on Mar. 31, 2005, the subject matter of which is incorporated herein by reference.

BACKGROUND OF THE INVENTION

This invention relates to magnetrons.

Magnetrons typically include (FIG. 1) a main body portion 1, an anode 2, often with vanes 3 to define resonant cavities 4, a coaxial cathode 5, means (not shown) for setting up a magnetic field parallel to the axis of the cathode, and an antenna 6 coupled to a probe 7 in a resonant cavity 4, for launching r.f. energy into a waveguide 8. The space between the anode and the cathode is evacuated, and the antenna 6 is also within the evacuated region, a glass dome 9 connected to a copper sleeve 10 forming part of the envelope.

The thickness of the glass dome 9 is not great, so the effect on the electrical length of the output is not great and, while the window does cause a mismatch because the r.f. energy encounters a change of dielectric constant resulting in reflections, the effect of this is reduced by the dome shape.

However, the manufacturing operation required to seal the glass dome to the copper sleeve 10 is time-consuming (a so-called Housekeeper copper/glass seal has to be formed due to the expansion coefficient of the glass) and therefore expensive.

SUMMARY OF THE INVENTION

The invention provides a magnetron comprising an antenna for launching r.f. energy along a waveguide, a dielectric window through which the r.f. energy is in use launched closing an evacuated region within the magnetron, and a conductive area on the window to the reduce the reflection of r.f. energy by the window.

The conductive area enables the mismatch which the window would otherwise cause to be reduced.

BRIEF DESCRIPTION OF THE DRAWINGS

One way of carrying out the invention will now be described in detail, by way of example, with reference to the accompanying drawings, in which.

DETAILED DESCRIPTION OF THE INVENTION

Figure 1:
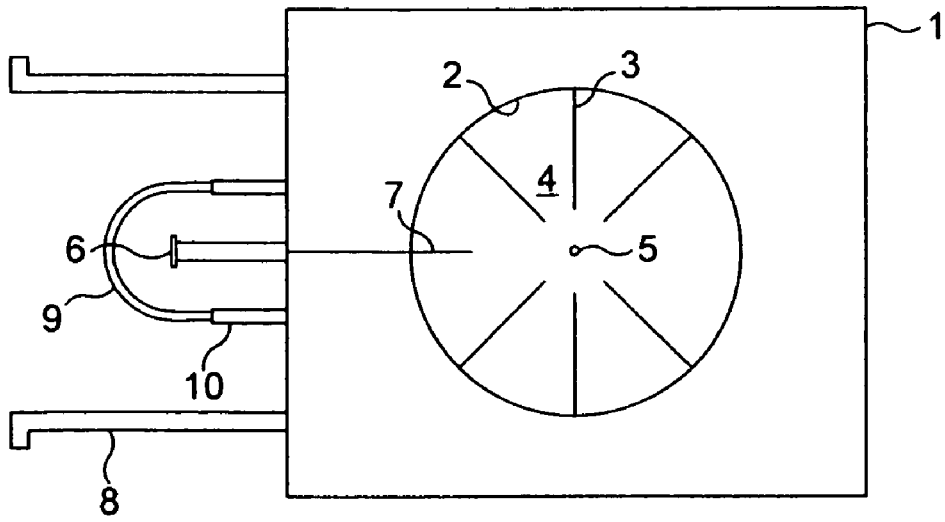
FIG. 1 PRIOR ART
FIG. 1 is an axial cross-section through a known magnetron, the section also being taken through the axis of a waveguide output.
Figure 2:
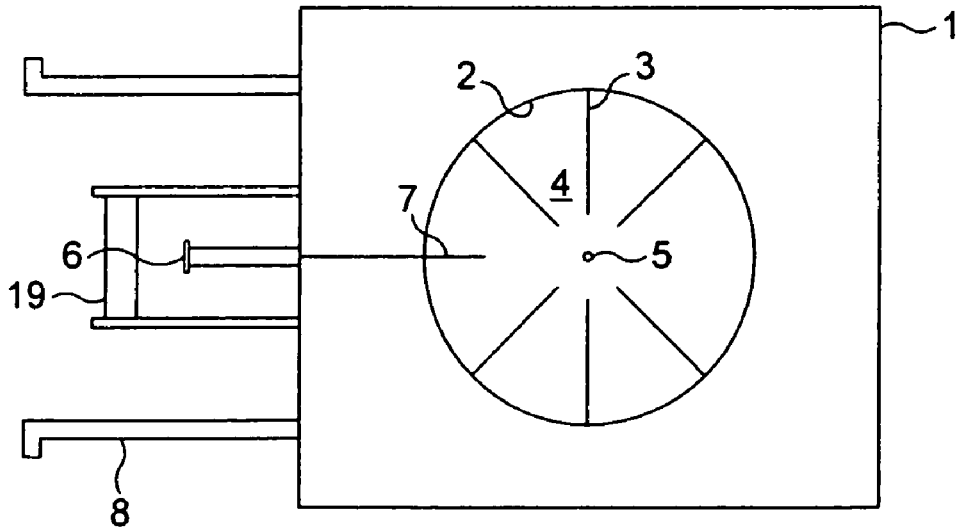
FIG. 2 is an axial cross-section through a magnetron according to the invention, the section also being taken through the axis of a waveguide output (indicated by the lines A-A in FIG. 3)
Figure 3:
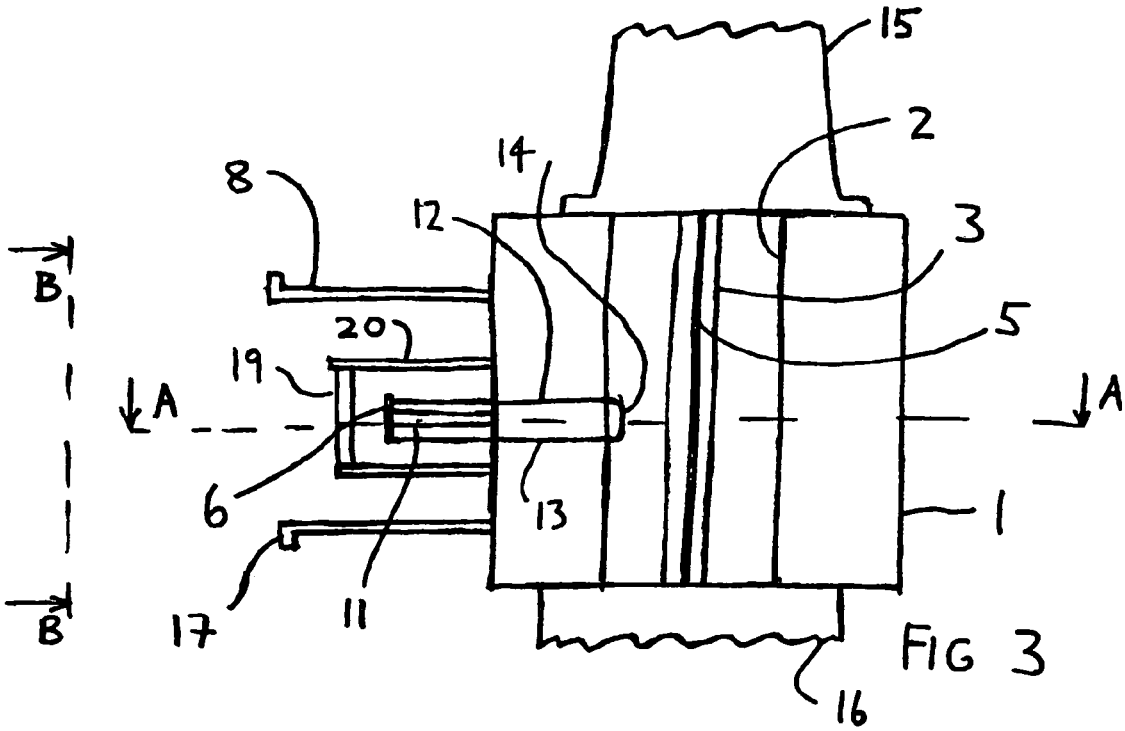
FIG. 3 is a section through the magnetron shown in FIG. 2, taken through the axis of the anode and through the axis of the waveguide output.
Figure 4:
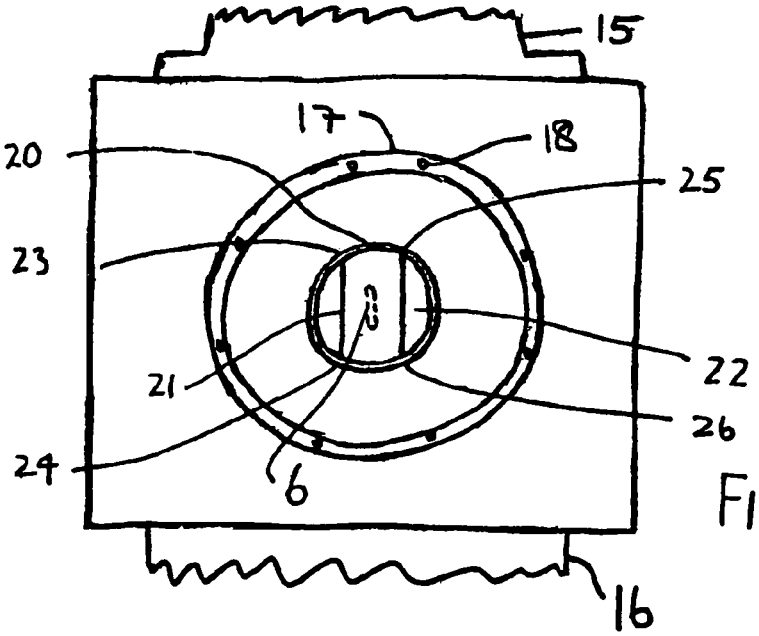
FIG. 4 is a front view taken on the lines B-B in FIG. 3.
Figure 5:
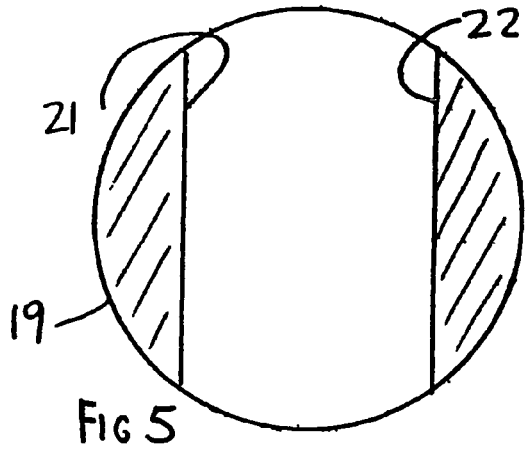
FIG. 5 shows the dielectric window of the magnetron of FIG. 2 on an enlarged scale.

Referring to FIGS. 2 to 5, the magnetron according to the invention comprises a longitudinally-extending anode 2 in a main body 1 having inwardly-extending vanes 3 defining resonant cavities 4, and a central coaxial cathode 5. Electrons emitted from the negatively-charged cathode interact with a magnetic field parallel to the axis of the anode generated by e.g. electromagnets (not shown), to generate r.f. energy by resonant interaction with the cavities. An antenna 6 extending parallel the axis of the anode is supported by a post 11 of copper, one quarter wavelength long so as to have no electrical effect but just provide mechanical support and heat conduction. The antenna is connected by conductors 12, 13 to a loop 14 in a resonant cavity 4.

The cathode 5 extends above the main body in a region closed by cover 15. Beneath the main body 1, a portion 16 contains means for cooling the main body portion of the magnetron, which is typically made of copper.

The r.f. energy radiated by the antenna 6 is launched along a waveguide 8 connected to the main body 1. The waveguide is a short section with a flange 17 at the end provided with apertures 18 to which a further waveguide section may be secured. Typically the radiation will be in the $TE_{10}$ mode. The antenna 6 is within the evacuated region of the magnetron. In accordance with the invention, this is closed by a dielectric window 19 bearing conductive areas, eg, sectors 21, 22, shown on an enlarged scale in FIG. 5.

In one embodiment, the dielectric window is a ceramic window, preferably disc-shaped. A suitable material is alumina, that is, aluminium oxide ($Al_2O_3$). The conductive areas are formed as follows. A molybdenum manganese mix is painted onto the face of the ceramic disc in the sector-shaped areas 21, 22, and also around the periphery of the window, and the window is then fired. Copper is then plated onto the sector-shaped areas 21,22 and nickel is plated around the periphery of the window. The window is then brazed to the interior of copper tube 20 which is in turn welded to the main body 1 of the magnetron.

R.f. energy launched from the antenna 6 encounters a change of dielectric constant when it meets the ceramic window 19, and reflections could therefore be expected because of the capacitive nature of the window. However, the conductive areas 21, 22 are inductive and compensate for the window capacity, thereby reducing reflections. It was found that there was a good wideband match with no obvious resonances or other problems.

Figure 6:
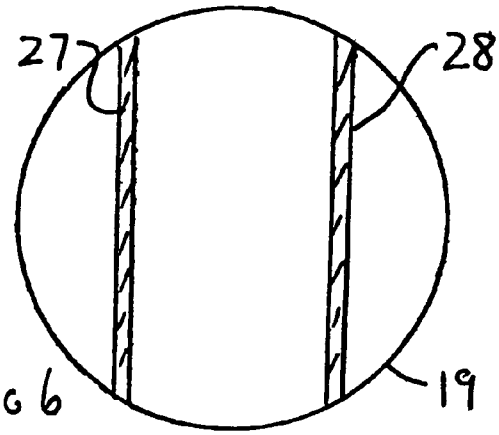
FIG. 6 shows the dielectric window with a first alternative conductive area.
Figure 7:
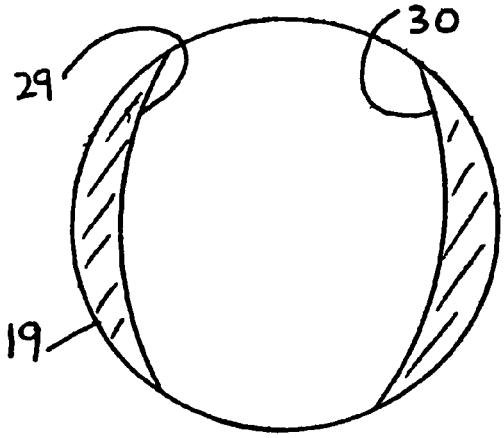
FIG. 7 shows the dielectric window with a second alternative conductive area.
Figure 8:
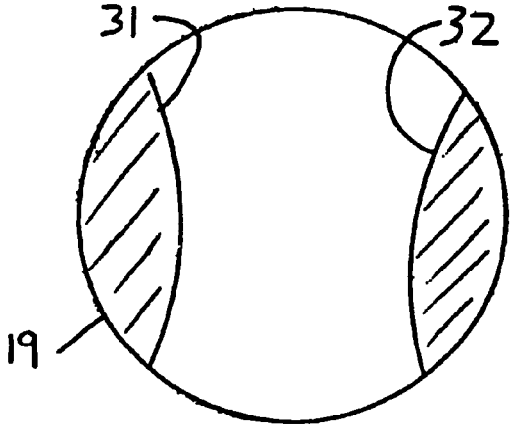
FIG. 8 shows the dielectric window with a third alternative conductive area.
Figure 1:
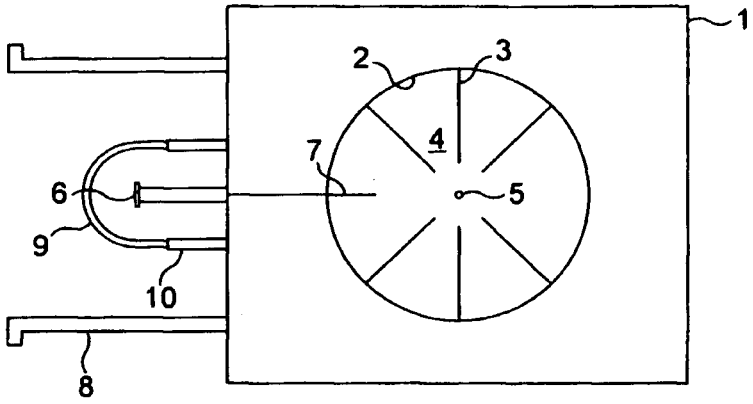
Figure 2:
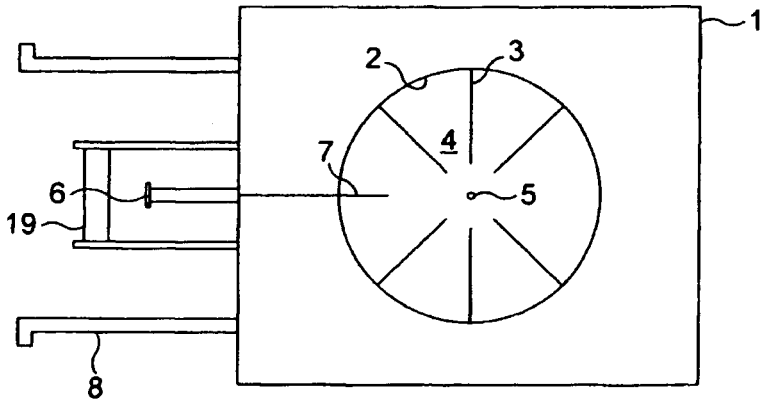
Figure 3:
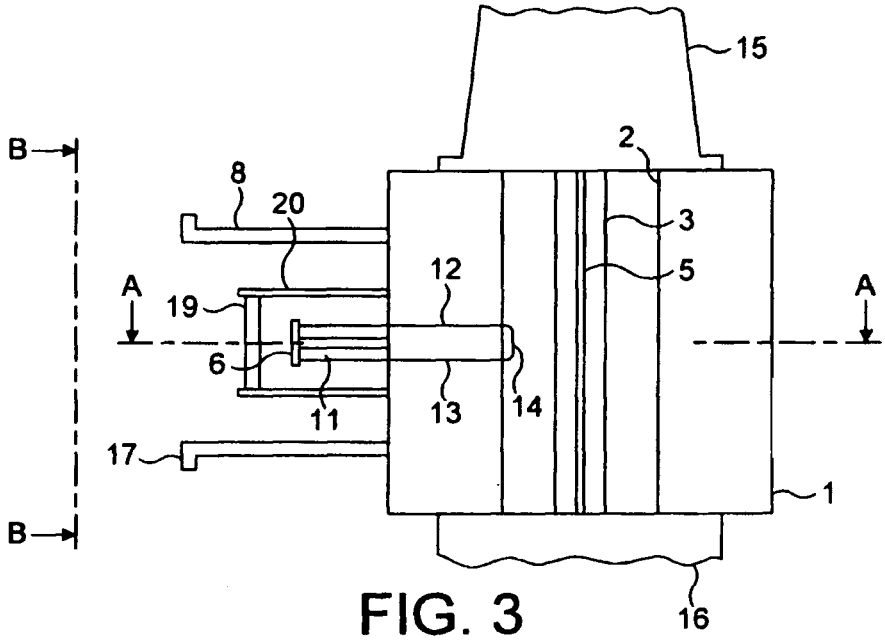
Figure 4:
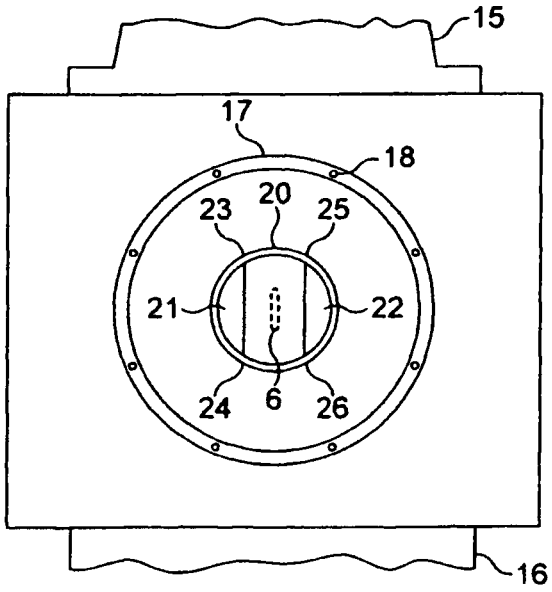
Figure 5:
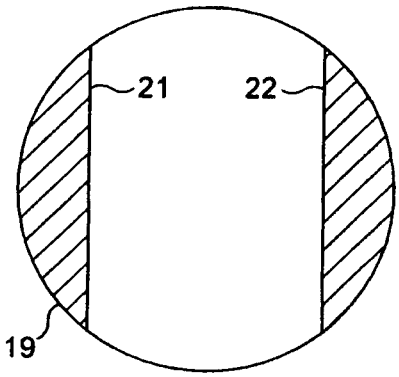
Figure 6:
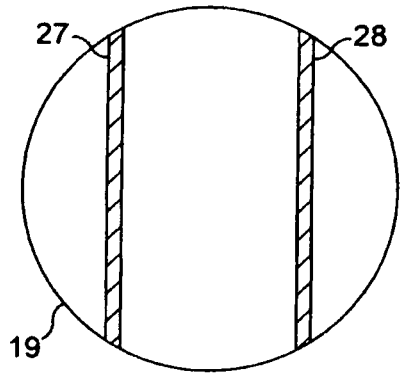
Figure 7:
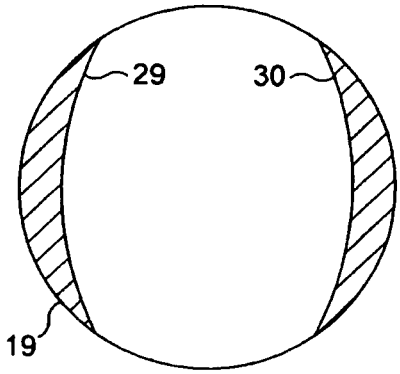
Figure 8:
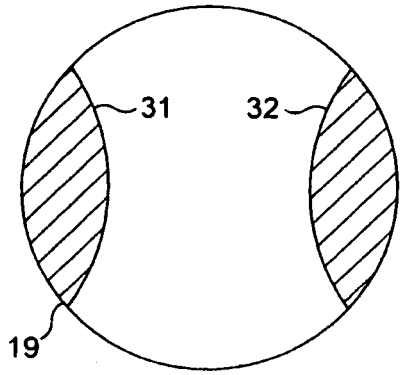

Variations are possible without departing from the scope of the invention. Thus, the regions do not have to be sector-shaped. For example, the conductive material could be arranged as straight-sided strips of conductive material 27, 28 (FIG. 6) positioned along the straight sides of the sectors, that is, extending between portions 23 and 24, and between portions 25 and 26, of the periphery of the copper tube 20. It is not even necessary for the conductive areas to be straight-sided, although it is desirable for each of them to contact the periphery of the tube 20 at two spaced apart portions around the circumference of the tube. For example, the inner sides of conductive areas which are sector-shaped on the outer sides could be concave 29, 30 (FIG. 7) or convex 31,32 (FIG. 8) with respect to the centre of the disc 19. Further, the conductive areas 21, 22; 27, 28; 29, 30; and 31, 32 could be plated onto both sides of the ceramic window, in register with each other, rather than just on one side as described.

The conductive areas could be deposited in other ways. Thus, for example, they could be applied by sputtering, wherein ions are directed by an electric field to a target such as copper or nickel in a vacuum chamber at low gas pressure, such that material of the target is removed by the ion impact and directed towards the window. Alternatively, the conductive areas could be applied by evaporating a metal in a vacuum chamber and allowing it to condense on the window.

A suitable thickness for the ceramic window is 2.6 mm, but the thickness could be anything in the range of from 1.5 mm to 4.0 mm. Also, materials other than ceramic could be used for the material of the dielectric window. For example, the window could be made of glass. Even when the window is a ceramic window, ceramics other than alumina could be used, such as beryllia, spinel, or boron nitride. Materials other than copper could be used as the conductive area, for example, nickel.

It is not essential for the ceramic window to be flat. It could be concave or convex.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A magnetron comprising an antenna for launching r.f. energy along a waveguide, a dielectric window through which the r.f. energy is in use launched closing an evacuated region within the magnetron, and a conductive area on the window to reduce reflection of the r.f. energy by the window.

2. A magnetron as claimed in claim 1, in which the window is a ceramic window.

3. A magnetron as claimed in claim 1, in which the window is planar.

4. A magnetron as claimed in claim 1, in which the periphery of the window is surrounded by a conductive region of the magnetron, and the conductive area is in contact with two spaced apart portions of the conductive region.

5. A magnetron as claimed in claim 4, in which the axis of the antenna extends parallel to a line joining the spaced apart portions.

6. A magnetron as claimed in claim 4, in which one boundary of the conductive region is the line joining the spaced apart portions.

7. A magnetron as claimed in claim 6, in which another boundary of the conductive region is the periphery of the window.

8. A magnetron as claimed in claim 7, in which the conductive region is sector-shaped.

9. A magnetron as claimed in claim 6, in which there is a pair of such conductive areas symmetrically arranged with respect to the antenna.

10. A magnetron as claimed in claim 9, in which there are pairs of such conductive areas on both sides of the window.

11. A magnetron as claimed in claim 1, in which the window is disc shaped.

12. A magnetron as claimed in claim 1, in which the window is rectangular.

* * * * *

UNITED STATES PATENT AND TRADEMARK OFFICE

CERTIFICATE OF CORRECTION

PATENT NO. : 7,327,088 B2
APPLICATION NO. : 11/394088
DATED : February 5, 2008
INVENTOR(S) : Michael Barry Clive Brady It is certified that error appears in the above-identified patent and that said Letters Patent is hereby corrected as shown below:

Title page should be deleted and substitute therefor the attached title page as shown on the attached page.

Drawings:
Delete Figures 1, 3-5, and 8 and replace with attached Figures 1, 3-5, and 8 as shown on the attached pages.

Signed and Sealed this
Thirty-first Day of May, 2011

David J. Kappos

David J. Kappos
*Director of the United States Patent and Trademark Office*

(12) United States Patent
Brady

(10) Patent No.: US 7,327,088 B2
(45) Date of Patent: Feb. 5, 2008

(54) MAGNETRON

(75) Inventor: Michael Barry Clive Brady, Maldon (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 68 days.

(21) Appl. No.: 11/394,088

(22) Filed: Mar. 31, 2006

(65) Prior Publication Data

US 2006/0220566 A1 Oct. 5, 2006

(30) Foreign Application Priority Data

Mar. 31, 2005 (GB) ..... 0506580.0

(51) Int. Cl.
*H01J 25/50* (2006.01)

(52) U.S. Cl. ..... 315/39.51; 315/39.53; 315/39.75

(58) Field of Classification Search ..... 315/39.51, 315/39.53, 39.55, 39.75
See application file for complete search history.

(56) References Cited

U.S. PATENT DOCUMENTS 3,114,123 A 12/1963 Kruechen et al.
5,998,934 A * 12/1999 Mimasu et al. ..... 315/118
6,653,788 B2 * 11/2003 Ogura et al. ..... 345/39.51

FOREIGN PATENT DOCUMENTS

GB 2 238 424 A 5/1991
GB 2 280 541 A 2/1995
GB 2 297 190 A 7/1996

OTHER PUBLICATIONS

United Kingdom Search Report Jun. 1, 2005.

* cited by examiner

*Primary Examiner*—David H. Vu
(74) *Attorney, Agent, or Firm*—Venable LLP; Robert Kinberg

(57) ABSTRACT

In a magnetron having a body 1 defining an anode 2 divided into resonant cavities 4 by vanes 3 and having a coaxial cathode 5, r.f. energy produced when a magnetic field is applied parallel to the axis of the anode is launched along a waveguide 8 by an antenna 6 in an evacuated region of the magnetron closed by a dielectric window 19. The latter has sector shaped conducting areas on its surface symmetrically arranged with respect to the antenna, the inductance of which balance the capacitance of the dielectric window, thereby reducing reflections at the window.

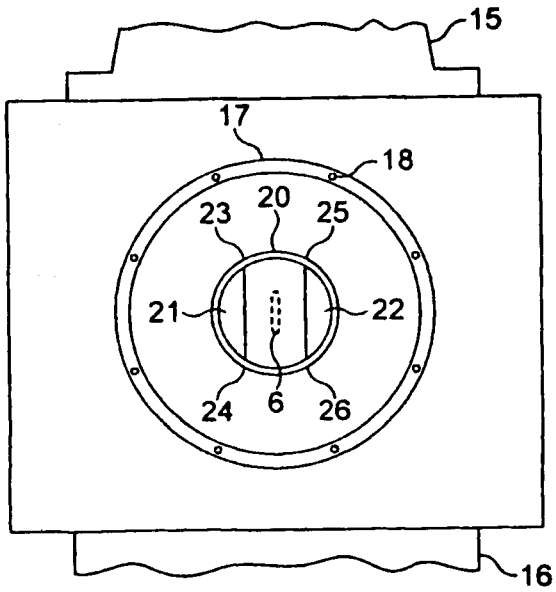

12 Claims, 3 Drawing Sheets